US009089161B2

(12) United States Patent
Kardachian

(10) Patent No.: US 9,089,161 B2
(45) Date of Patent: Jul. 28, 2015

(54) METHOD FOR MODIFYING A BASE WATER MATRIX PRIOR TO ADDING A SUPER ABSORBANT ACRYLIC BASED COPOLYMER SUCH AS IN ORDER TO FORM A FLAVORED GELATINOUS COMPOSITION SUITED FOR USE WITH SMOKING DEVICES

(71) Applicant: Hratch A. Kardachian, Monroe, MI (US)

(72) Inventor: Hratch A. Kardachian, Monroe, MI (US)

( * ) Notice: Subject to any disclaimer, the term of this patent is extended or adjusted under 35 U.S.C. 154(b) by 0 days.

(21) Appl. No.: 14/179,015

(22) Filed: Feb. 12, 2014

(65) Prior Publication Data

US 2014/0224266 A1 Aug. 14, 2014

Related U.S. Application Data

(60) Provisional application No. 61/763,785, filed on Feb. 12, 2013.

(51) Int. Cl.
*A24B 15/18* (2006.01)

(52) U.S. Cl.
CPC ..... *A24B 15/18* (2013.01)

(58) Field of Classification Search
USPC ..... 131/300, 329, 3, 30, 173, 35, 2
See application file for complete search history.

(56) References Cited

U.S. PATENT DOCUMENTS

| | | | | |
|---|---|---|---|---|
| 5,314,420 | A | 5/1994 | Smith et al. | |
| 5,399,591 | A | 3/1995 | Smith et al. | |
| 5,451,613 | A | 9/1995 | Smith et al. | |
| 5,462,972 | A | 10/1995 | Smith et al. | |
| 7,396,584 | B2 | 7/2008 | Azad et al. | |
| 8,627,828 | B2 * | 1/2014 | Strickland et al. | 131/352 |
| 2003/0203991 | A1 | 10/2003 | Schottman et al. | |
| 2006/0173431 | A1 | 8/2006 | Laumer et al. | |
| 2008/0058747 | A1 | 3/2008 | Singh Kainth et al. | |
| 2009/0204087 | A1 | 8/2009 | Herfert et al. | |
| 2012/0269879 | A1 | 10/2012 | Watson | |

FOREIGN PATENT DOCUMENTS

| | | | |
|---|---|---|---|
| WO | 2010125191 | A2 | 11/2010 |
| WO | 2012054111 | A1 | 4/2012 |

OTHER PUBLICATIONS

International Search Report, Writtten Opinion, PCT/US2014/015991, 5 pages, 2014.

* cited by examiner

*Primary Examiner* — Dennis Cordray
(74) *Attorney, Agent, or Firm* — Gifford, Krass, Sprinkle, Anderson & Citkowski, P.C.

(57) ABSTRACT

A method for modifying a base water matrix, prior to the addition of a super absorbent copolymer in order to create a flavored and combustible gelatinous composition. A distilled water is provided, to which is added a percentage by volume or weight of a glycerin. An emulsifier is added, the water/glycerin/emulsifier matrix being mixed for a determined time interval. A natural flavoring is added mixed again concurrent with applying heat to a combined liquid matrix, along with adding an acrylic based super absorbent copolymer with cross linking agent to the combined liquid matrix to create a final mixture, which is then stored in a temperature controlled environment for a further determined time interval in order to permit the copolymer to completely absorb the combined liquid matrix concurrent with three dimensional expansion into the gelatinous composition.

7 Claims, 2 Drawing Sheets

METHOD FOR MODIFYING A BASE WATER MATRIX PRIOR TO ADDING A SUPER ABSORBANT ACRYLIC BASED COPOLYMER SUCH AS IN ORDER TO FORM A FLAVORED GELATINOUS COMPOSITION SUITED FOR USE WITH SMOKING DEVICES

CROSS-REFERENCE TO RELATED APPLICATIONS

This Application claims the benefit of U.S. Provisional Application 61/763,785 filed on Feb. 12, 2013, the contents of which are incorporated herein in its entirety.

FIELD OF THE INVENTION

The present invention relates generally to acrylic acid based superabsorbent polymers, such as which include a cross linking agent for reacting with and absorbing water in order to create a gelatinous composition. More specifically, the present invention discloses a process and method for modifying a base water matrix, such as through the addition of glycerin and honey powder and which, along with an added flavoring ingredient, is thoroughly mixed prior to the addition of such as an Acrylamide/Potassium Acrylate Copolymer (AgSAP) according to a given ratio. The composition is then stored in temperature controlled conditions for a given time interval in order to permit the AgSAP to absorb all of the matrix liquid and to form a gel which can be combusted and is ground or sectioned for use with smoking devices.

BACKGROUND OF THE INVENTION

Polymeric based absorbent article and compositions, such as gels are generally known in the art. A first example of this is set forth in the coating composition of Schottman et al., U.S. 2003/0203991, which is applied as a hydrophilic coating to medical devices and which consists of an aqueous polymeric matrix, a hydrophilic polymer, a colloidal metal oxide and a cross linker.

Singh Kainth et al., U.S. 2008/0058747, teaches an absorbent article having a top sheet, a back sheet and an absorbent core, the core having layers of superabsorbent material and at least one of which includes substantially fluff. Laumer et al., U.S. 2006/0173431, similarly teaches an absorbent article with a fluid pervious topsheet, a fluid impervious backsheet and an absorbent core again including a superabsorbent material including a base polymer having a surface coating incorporating a poly-ammonium carbonate.

Azad et al., U.S. Pat. No. 7,396,584, teaches a cross-linked polyamine coating applied to superabsorbent gels. The gels include superabsorbent particles, each with a shell incorporating a cationic polymer cross linked by the addition of a cross-linker and adhered to a hydrogel forming polymer obtainable by applying a coating solution containing both a cationic polymer and cross linker, the hydro-gel forming polymer having a residual water content of less at 10 w %.

Herfert et al., U.S. 2009/0204087, teaches superabsorbent polymer particles having superior gel integrity, absorption capacity, and peremeability. Also disclosed is a method of producing the superabsorbent polmer particles by applying a polyamine coating to the particles. Finally, each of U.S. Pat. Nos. 5,314,420, 5,399,591, 5,451,613 and 5,462,972, all to Smith et al., teach variations of a superabsorbent polymer exhibiting improved absorption under pressure and fast absorption rate. These include such as providing a solution containing a carboxylic acid monomer or water soluble salt along with a cross linking agent or blowing agent. In given applications, the polymer is subsequently treated with a surface cross-linking agent.

SUMMARY OF THE INVENTION

The present invention discloses a method for modifying a base water matrix, prior to the addition of a super absorbent copolymer, and in order to create flavored and combustible gelatinous composition. The method includes the steps of providing a distilled water, adding a percentage by volume or weight of a glycerin, adding an emulsifier, and mixing the water/glycerin/emulsifier matrix for a determined time interval. Additional steps include adding a natural flavoring and mixing again concurrent with applying heat to a combined liquid matrix, along with adding an acrylic based super absorbent copolymer with cross linking agent in a determined ratio by weight to the combined liquid matrix to create a final mixture and again mixing for an additional time interval and storing the final mixture in a temperature controlled environment for a further determined time interval in order to permit the copolymer to completely absorb the combined liquid matrix concurrent with three dimensional expansion into the gelatinous composition.

Additional steps include the adding of glycerin by combining ⅓ distilled water to ⅔ glycerin by weight, as well as the adding of an emulsifier by combining a 1% by weight of honey powder. The step of adding a natural flavoring may further include adding any of a soluble liquid, powder or granule in a percentage of 5%-7% by weight to the water/glycerin/emulsifier matrix.

Yet additional steps include the adding of an acrylic based super absorbent copolymer with cross linking agent further including an Acrylamide/Potassium Acrylate Copolymer (AgSAP), as well as adding, to the combined liquid matrix, the AgSAP copolymer in a ratio of 200 parts liquid to 1 part AgSAP. Also included is the step of any of cutting (e.g. dicing), scraping, abrading or grounding of the three dimensionally expanded gelatinous composition into smaller diameter sized portions, thereby facilitating the subsequent use of the combustible gel into such as a hookah pipe assembly.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

As previously described, the present invention relates generally to acrylic acid based superabsorbent polymers, such as which include a cross linking agent for reacting with and absorbing water in order to create a gelatinous composition. More specifically, the present invention discloses a process and method for modifying a base water matrix, such as through the addition of glycerin and honey powder and which, along with an added flavoring ingredient, is thoroughly mixed prior to the addition of such as an Acrylamide/Potassium Acrylate Copolymer (AgSAP) according to a given ratio. As will be further described, the composition is then stored in temperature controlled conditions for a given time interval in order to permit the AgSAP to absorb all of the matrix liquid and to form a gel which can be combusted and is ground or sectioned for use with smoking devices.

Figure 1:
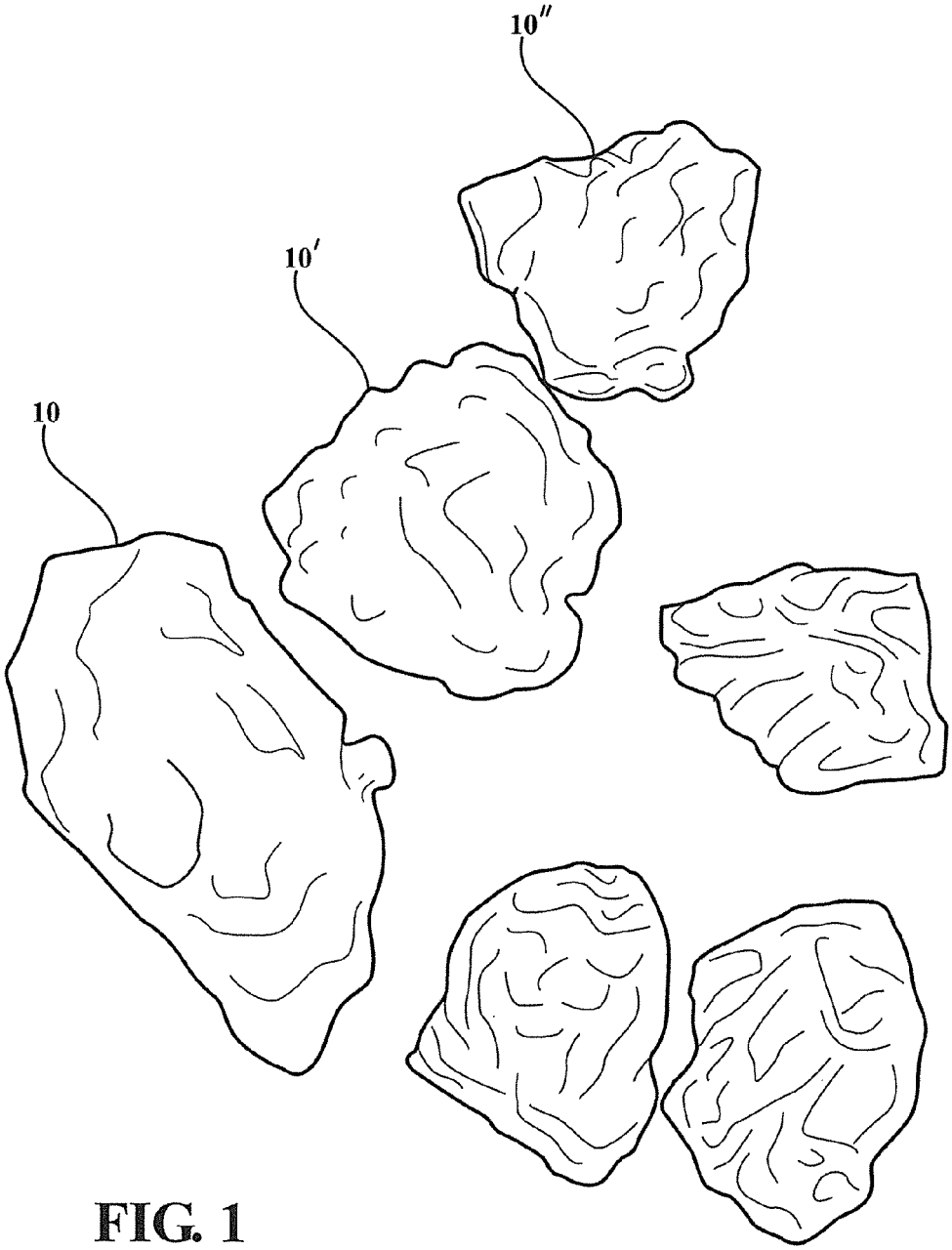
FIG. 1 is an environmental view of a flavored gelatinous material produced according to the present invention and which can be combusted such as with smoking devices.

FIG. 1 is an environmental view illustrating a variety of flavored gelatinous material, see as depicted at 10, 10', 10" et seq., and which are produced according to the process and method of the present invention. In one non-limiting application, the material is constructed so that it can be combusted such as with smoking devices (e.g a hookah pipe or the like). As is known, acrylic copolymers are petro-chemical based and, with the use of the correct cross linking agent, can create a combustible gelatinous composition.

Figure 2:
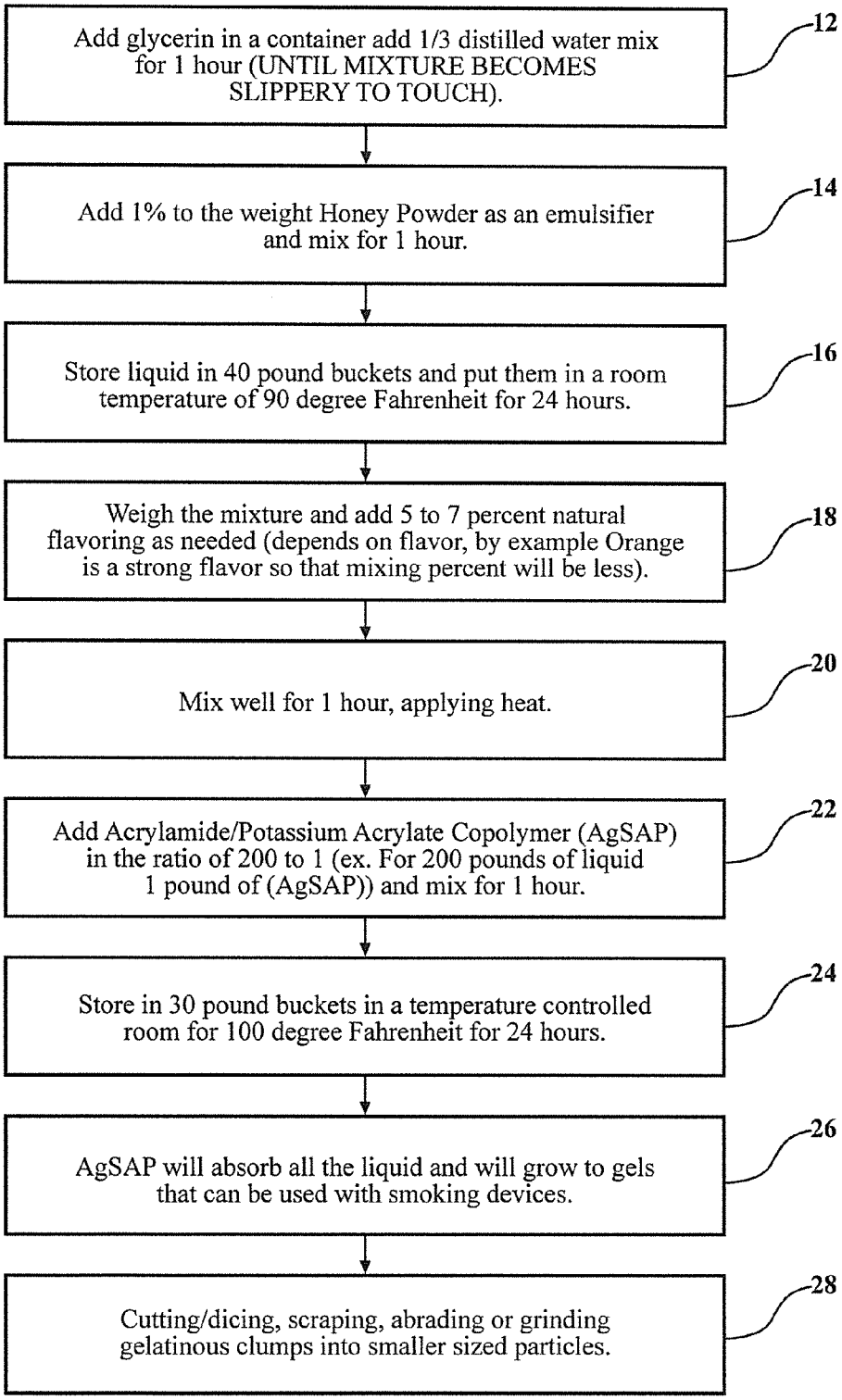
FIG. 2 is a formula representation for modifying a distilled water base with each of glycerin, honey powder and natural flavoring, prior to the addition of an acrylic based superabsorbent copolymer in order to create the gelatinous combustible material.

Referring to FIG. 2, a formula representation is depicted in schematic fashion of a process for modifying a distilled water base with each of glycerin, honey powder and natural flavoring, prior to the addition of an acrylic based superabsorbent copolymer in order to create the gelatinous combustible material. This includes, in an initial step 12, combining an amount of a glycerin material according to a given percentage or ratio by volume or weight to a distilled water (such as without limitation a percentage by volume or weight of ⅔ glycerin to ⅓ distilled water) and until the base matrix composition exhibits a substantially slippery consistency.

As is known, glycerin is a simple polyol compound that is both sweet tasting and of low toxicity. It is a colorless, odorless, viscous liquid that is widely used in pharmaceutical formulations. Glycerol has three hydroxyl groups that are responsible for its solubility in water and its hygroscopic nature. This glycerol backbone is central to all lipids known as triglycerides.

In a second step 14, an emulsifier such as Honey Powder is added, in one non-limited application by 1% to the combined weight of the distilled water/glycerin matrix. Emulsifiers (also known as "emulgents") are substances that stabilize an emulsion (defined as colloidal suspension of a liquid in another liquid) by increasing its kinetic stability. One class of emulsifiers is known as "surface active substances", or surfactants (i.e. surface active agents).

Honey powder is further classified as a dehydrated honey which is spray dried into a fine powder and is similar in texture to corn flour. It can range in color from very white to a sort of creamy yellow color similar to fine powdered sugar or protein powder and is blended with fructose and maltodextrin to keep it free flowing. A very high heat is used in the process to create this powder, although some producers even freeze dry the honey, to spray to a fine dry powder. To keep the honey from clumping and remaining in a powdery form, sugar, starch or other stabilizers are added.

In a third step 16, the liquid mixture is stored, such as in one non-limiting application in 40 lb buckets, and placed in a climate controlled environment for a period of time, such as in one non-limiting application 90° Fahrenheit for 24 hours. In a fourth step 18, the individual volumes of mixtures are again weighed, following which a soluble liquid, powder or granule of a natural flavoring is added as a percentage by weight (such as 5%-7%) to the mixture.

Without limitation, such flavorings can include cherry, blueberry, etc. Given the strong characteristics of given flavorings, such as orange, a smaller percentage by weight may be used. Reciprocally, a larger percentage of weight can be employed for other lesser scented flavorings, the list of which is endless. At this step, additional colorings by minute percentage of weight or volume, can be added and which correspond to the intended flavorings (i.e. blue for blueberry flavoring, red for cherry, orange for orange, etc.).

In a fifth step 20, the combined liquid matrix is mixed for a period of time (such as without limitation for sixty minutes), during which heat is applied at a desired elevated temperature. In a sixth stage or step 22, a super absorbent copolymer is added. The copolymer is typically an acrylic (petro-chemical) based composition (originating as acrylic acid). In one non-limiting application, an Acrylamide/Potassium Copolymer (AgSAP) is utilized as the superabsorbent copolymer and is added in a ratio by weight, of 200 to 1 (e.g. 200 lbs of matrix liquid to 1 pound of AgSAP).

As is known in the art, such polyacrylates are also used as thickening agents or rheology modifiers. The reason is for their hydrogen bonding interaction with water molecules. In a dry state, a polyacrylate is curled up like a pigs tail. However, once surrounded by water molecules, the interaction between H and O on the chains and from the water molecules causes these chains straighten out like strands of spaghetti: Once straightened out, these polymer strands exert greater resistance in fluid flow thereby thickening the fluid.

The basic idea in designing a superabsorbent polymer is to build small crosslinking bonds between the polymer strands so that they are kept linked as they straighten out. Accordingly, and by adding more and more chains and then partially neutralizing the —COOH acid groups, this results in a three dimensional expansion of the composition. This then forms a kind of a "cage" where water molecules are drawn inside and then held in place there through Hydrogen bonding, thus requiring on a relatively small amount of a absorbent copolymer with crosslinking agent, typically on the order of ¼-½% by weight to accomplish complete absorption of a much ratio of liquid, such as again on the order of 200/1.

In a seventh step 24, the now gelatinous composition is stored in given subdivided weights (e.g. in 301*b* buckets in one non-limiting application) and temperature controlled room (such as at 100° F.) for a given time interval (e.g. 24 hours). During this time, the AgSAP will completely absorb all of the liquid, according to the above described chemical process, during growth into its final three dimensional gelatinous shape (step 26).

A final step 28 can include any of cutting (e.g. dicing), scraping, abrading or grinding of the three dimensional gelatinous clumps into the smaller (typically irregular) diameter sized portions depicted in FIG. 1, this facilitating the subsequent use of the combustible gel into such as a hookah pipe assembly (not shown).

Having described my invention, other and additional preferred embodiments will become apparent to those skilled in the art to which it pertains, and without deviating from the scope of the appended claims.

I claim:

1. A method for modifying a base water matrix to create a flavored and combustible gelatinous composition, said method comprising the steps of:

providing a distilled water;

adding a percentage by volume or weight of a glycerin;

adding an emulsifier;

mixing the water/glycerin/emulsifier matrix for a determined time interval;

adding a natural flavoring and mixing again concurrent with applying heat to form a combined liquid matrix;

adding an acrylic based super absorbent copolymer with cross linking agent to the combined liquid matrix to create a final mixture and again mixing for an additional time interval; and storing the final mixture in a temperature controlled environment for a further determined time interval in order to permit the copolymer to completely absorb the combined liquid matrix concurrent with three dimensional expansion into the gelatinous composition.

2. The method as described in claim 1, wherein said glycerin is added to said distilled water at a ratio of ⅓ distilled water to ⅔ glycerin by weight.

3. The method as described in claim 1, wherein said emulsifier comprises honey powder added at 1% by weight of said distilled water and said glycerin.

4. The method as described in claim 1, said natural flavoring comprising any of a soluble liquid, powder or granule in a percentage of 5%-7% by weight to the water/glycerin/emulsifier matrix.

5. The method as described in claim 1, said acrylic based super absorbent copolymer comprises an Acrylamide/Potassium Acrylate Copolymer (AgSAP).

6. The method as described in claim 5, further, wherein said AgSAP copolymer is added in a ratio of 1 part AgSAP to 200 parts combined liquid matrix.

7. The method as described in claim 1, further comprising the step of any of cutting, dicing, scraping, abrading or grinding of said gelatinous composition into smaller diameter sized portions, thereby facilitating the subsequent use of the gelatinous composition into such as a hookah pipe assembly.

* * * * *